US011154453B2

(12) United States Patent
Ross

(10) Patent No.: US 11,154,453 B2
(45) **Date of Patent: *Oct. 26, 2021**

(54) INTELLIGENT COMPRESSION WRAP

(71) Applicant: Government of the United States as Represented by the Secretary of the Air Force, Wright-Patterson AFB, OH (US)

(72) Inventor: Lewis Tyson Ross, Franklin, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/686,627

(22) Filed: Nov. 18, 2019

(65) Prior Publication Data

US 2020/0093680 A1 Mar. 26, 2020

Related U.S. Application Data

(63) Continuation of application No. 15/493,332, filed on Apr. 21, 2017, now Pat. No. 10,524,976.
(Continued)

(51) Int. Cl.
*A61H 11/00* (2006.01)
*A61H 7/00* (2006.01)
(Continued)

(52) U.S. Cl.
CPC ..... *A61H 11/00* (2013.01); *A61H 7/007* (2013.01); *A61H 9/0007* (2013.01); *A61H 11/02* (2013.01); *A61H 36/00* (2013.01); *A61H 2011/005* (2013.01); *A61H 2201/0207* (2013.01); *A61H 2201/0228* (2013.01); *A61H 2201/10* (2013.01); *A61H 2201/1207* (2013.01); *A61H 2201/164* (2013.01); *A61H 2201/165* (2013.01); *A61H 2201/169* (2013.01);
(Continued)

(58) Field of Classification Search
CPC ..... A61H 11/00; A61H 7/007; A61H 2201/5082; A61H 2201/5097
See application file for complete search history.

(56) References Cited

U.S. PATENT DOCUMENTS 6,123,681 A * 9/2000 Brown, III ..... A61H 23/02 2/239
6,511,508 B1 1/2003 Shahinpoor et al.
(Continued)

OTHER PUBLICATIONS

T. H. Ware et al., "Voxelated liquid crystal elastomers," Science, vol. 347 (2015) 982-984.

*Primary Examiner* — Timothy A Stanis
(74) *Attorney, Agent, or Firm* — AFMCLO/JAZ; Chastity D. S. Whitaker

(57) ABSTRACT

An intelligent compression device for controllable compression. The compression device includes a compressible body and a microprocessor. The compressible body encircles a limb of a user and includes an elastomer layer and an activation layer. The elastomer layer includes voxelated liquid crystal elastomers that contract in response to a stimulus. The activation element, which is positioned proximate to the elastomer layer, supplies the stimulus. The microprocessor actuates at least a portion of the activation element layer.

18 Claims, 8 Drawing Sheets

Related U.S. Application Data

(60) Provisional application No. 62/325,793, filed on Apr. 21, 2016.

(51) Int. Cl.
*A61H 9/00* (2006.01)
*A61H 36/00* (2006.01)
*A61H 11/02* (2006.01)

(52) U.S. Cl.
CPC ..... *A61H 2201/1635* (2013.01); *A61H 2201/1647* (2013.01); *A61H 2201/1697* (2013.01); *A61H 2201/501* (2013.01); *A61H 2201/5002* (2013.01); *A61H 2201/5015* (2013.01); *A61H 2201/5071* (2013.01); *A61H 2201/5082* (2013.01); *A61H 2201/5097* (2013.01); *A61H 2209/00* (2013.01)

(56) References Cited

U.S. PATENT DOCUMENTS 7,259,503 B2 8/2007 Pei et al.
7,456,549 B2 11/2008 Heim et al.
7,491,185 B2 * 2/2009 Couvillon, Jr. ..... A61H 31/005 601/148
7,785,656 B2 8/2010 Pei et al.
7,868,221 B2 * 1/2011 Munch-Fals ..... A61H 31/006 602/41
7,936,404 B2 5/2011 Spillmann et al.
9,326,911 B2 5/2016 Wyatt et al.
2003/0212306 A1 11/2003 Banik
2005/0105158 A1 5/2005 Faris
2010/0056966 A1 3/2010 Toth
2014/0081187 A1 * 3/2014 Wyatt ..... A61H 7/007 601/152
2015/0025426 A1 * 1/2015 Larson ..... A61H 23/0245 601/134
2015/0065930 A1 * 3/2015 Wyatt ..... A61H 9/0078 601/150
2015/0315012 A1 11/2015 Wiersma
2016/0312120 A1 10/2016 White et al.
2016/0313607 A1 10/2016 White et al.

* cited by examiner

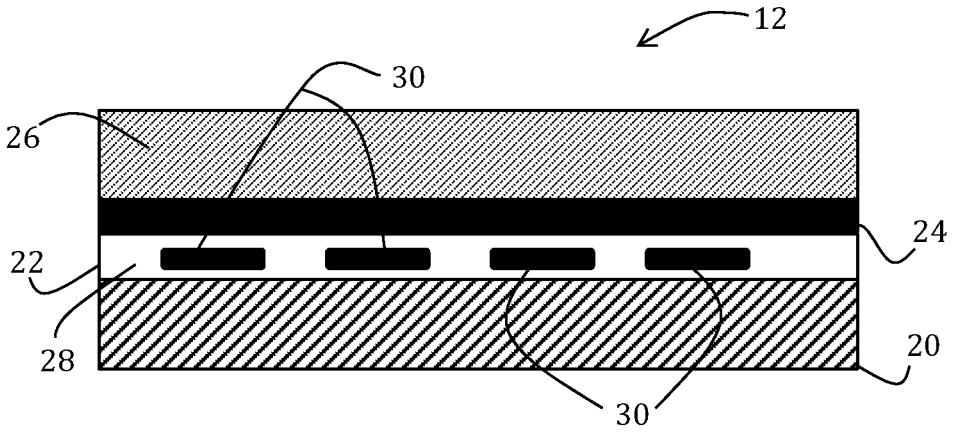
FIG. 2
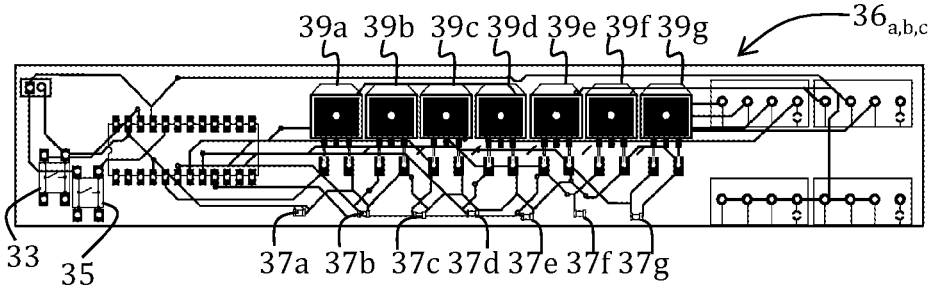
FIG. 4
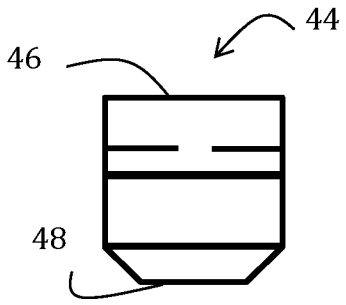
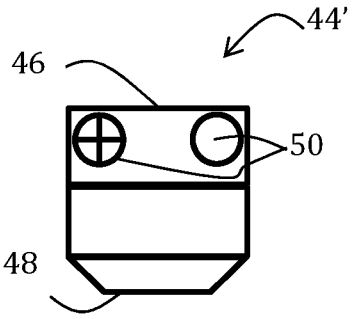
FIG. 7A FIG. 7B

INTELLIGENT COMPRESSION WRAP

This application is a continuation of U.S. application Ser. No. 15/493,332, filed Apr. 21, 2017, which claimed the benefit of and priority to prior filed Provisional Application Ser. No. 62/325,793, filed Apr. 21, 2016. The disclosure of each application is expressly incorporated herein by reference, in its entirety.

RIGHTS OF THE GOVERNMENT

The invention described herein may be manufactured and used by or for the Government of the United States for all governmental purposes without the payment of any royalty.

FIELD OF THE INVENTION

The present invention relates generally to compression wraps and, more particularly, to adjustable compression wraps.

BACKGROUND OF THE INVENTION

Blood flow disorders can lead to numerous health and cosmetic problems for people. Relatively immobile patients, such as post-operative patients, the bedridden, and those individuals suffering from lymphedema and diabetes. Travelers confined to tight quarters during airline travel, for example, are particularly at risk for the development of thromboses, or blood clots due to decreased blood flow. Varicose veins are another disorder resulting from problems with patient blood flow. Varicose veins are often a symptom of an underlying condition called venous insufficiency. Normal veins have one-way valves that allow blood to flow upward only to return to the heart and lungs. A varicose vein has valves that are not functioning properly. The blood can flow upwards, but tends to pool in the vein because of valve dysfunction. The varicose veins bulge because they are filled with pooled blood. Although varicose veins are often a cosmetic concern, the condition also causes pain, leg heaviness, fatigue, itching, night cramps, leg swelling, and restless legs at night. Varicose vein disease can be treated with various nonsurgical techniques such as sclerotherapy or endovenous laser treatment ("EVLT"). In some cases enhanced blood flow is essential for quality of life, such as for those individuals suffering from RVD (peripheral vascular disease) and RLS (restless leg syndrome), or women undergoing reconstructive breast surgery suffering from arm pain and fatigue due to poor blood flow.

For some individuals the condition can also be treated by the nightly use of compression stockings. Compression stockings are elastic stockings that squeeze the veins and stop excess blood from flowing backward. These, and other known devices, tend to only provide an initial compression force at a low level that decreases over time upon continued deformation of the stocking.

Many athletes, whether professionals or lay persons, suffer from muscle soreness, pain and fatigue after exercise due to toxins and other workout by-products being released. Recent research has shown that compression garments may provide ergogenic benefits for athletes during exercise by enhancing lactate removal, reducing muscle oscillation, and positively influencing psychological factors. Some early research on compression garments has demonstrated a reduction in blood lactate concentration during maximal exercise on a bicycle ergometer. Later investigations have shown improved repeated jump power and increased vertical jump height. The suggested reasons for the improved jumping ability with compression garments include an improved warm-up via increased skin temperature, reduced muscle oscillation upon ground contact, and increased torque generated about the hip joint. Combined, these results show that compression garments may provide both a performance enhancement and an injury reduction role during exercises provoking high blood lactate concentrations or explosive-based movements.

Research has also shown that compression garments may promote blood lactate removal and therefore enhance recovery during periods following strenuous exercise. In one test, significant reduction in blood lactate levels in highly fit were observed in males wearing compression stockings following a bicycle ergometer test at 110% $VO_{2max}$. Similar results were obtained in a later study in which a significant reduction in blood lactate concentration and an increased plasma volume was found in twelve elderly trained cyclists wearing compression garments following five minutes of maximal cycling. In another test, wearing compression garments during an 80 minute rest period following the five minutes of maximal cycling were shown to significantly increase (2.1%) performance during a subsequent maximal cycling test. It was suggested that increased removal of the metabolic by-products during intense exercise when wearing compression garments may help improve performance. These results suggest that wearing compression garments during recovery periods following high intensity exercise may enhance the recovery process both during and following intense exercise and therefore improve exercise performance.

Compression devices have also been used during recovery periods for athletes following strenuous activity. These devices are generally limited to the athlete's legs and typically comprise a series of inflatable bladders in a heel-to-thigh casing. An air pump inflates the series of bladders in a predetermined sequence to stimulate arterial blood flow through the athlete's legs. Compression devices of this type are extremely bulky, requiring that the athlete remain generally immobile, either seated or in a prone position.

More recently, improved compression devices have been described, as in U.S. Application Publication No. 2014/0081187, entitled COMPRESSION INTEGUMENT, by Wyatt et al. (the disclosure of which is incorporated herein by reference, in its entirety), and include comfortable and mobile devices. Such devices have incorporated shape memory materials and include a level of self-regulation. Yet, there remains a need for still better improved compression devices that yield more control of levels of constriction, are further self-regulating, and may be incorporated in additional therapies, such as to stimulate blood flow.

SUMMARY OF THE INVENTION

The present invention overcomes the foregoing problems and other shortcomings, drawbacks, and challenges of conventional devices. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, an intelligent compression device for controllable compression includes a compressible body and a microprocessor. The compressible body encircles a limb of a user and includes an elastomer layer and an activation layer. The elastomer layer includes voxelated liquid crystal elastomers that contract in response to a stimulus. The activation element, which is positioned proximate to the elastomer layer, supplies the stimulus. The microprocessor actuates at least a portion of the activation element layer.

According to another embodiment of the present invention, a method of using the compression device includes activating the activation element layer at a first level to supply the stimulus and contracting the elastomer layer. A level of applied pressure is determined and, based on that determination, activation of the activation element is adjusted to a second level.

Yet another embodiment of the present invention includes an intelligent compression device for controllable compression includes a compressible body and a microprocessor. The compressible body encircles a limb of a user and includes an elastomer layer that comprises a plurality of bands. The bands of the plurality comprising electro active polymers that contract in response to a stimulus. An energy supply provides an electrical stimulus to actuate at least a portion of the elastomer layer.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

FIG. 2 is a cross-sectional view taken through the compression wrap of FIG. 1, along the line 2-2.

FIG. 4 is a side elevational view of an exemplary distribution circuit board suitable for use with embodiments of the present invention.

FIGS. 7A and 7B are side elevational views compressible pads suitable for use with compression devices according to various embodiments of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
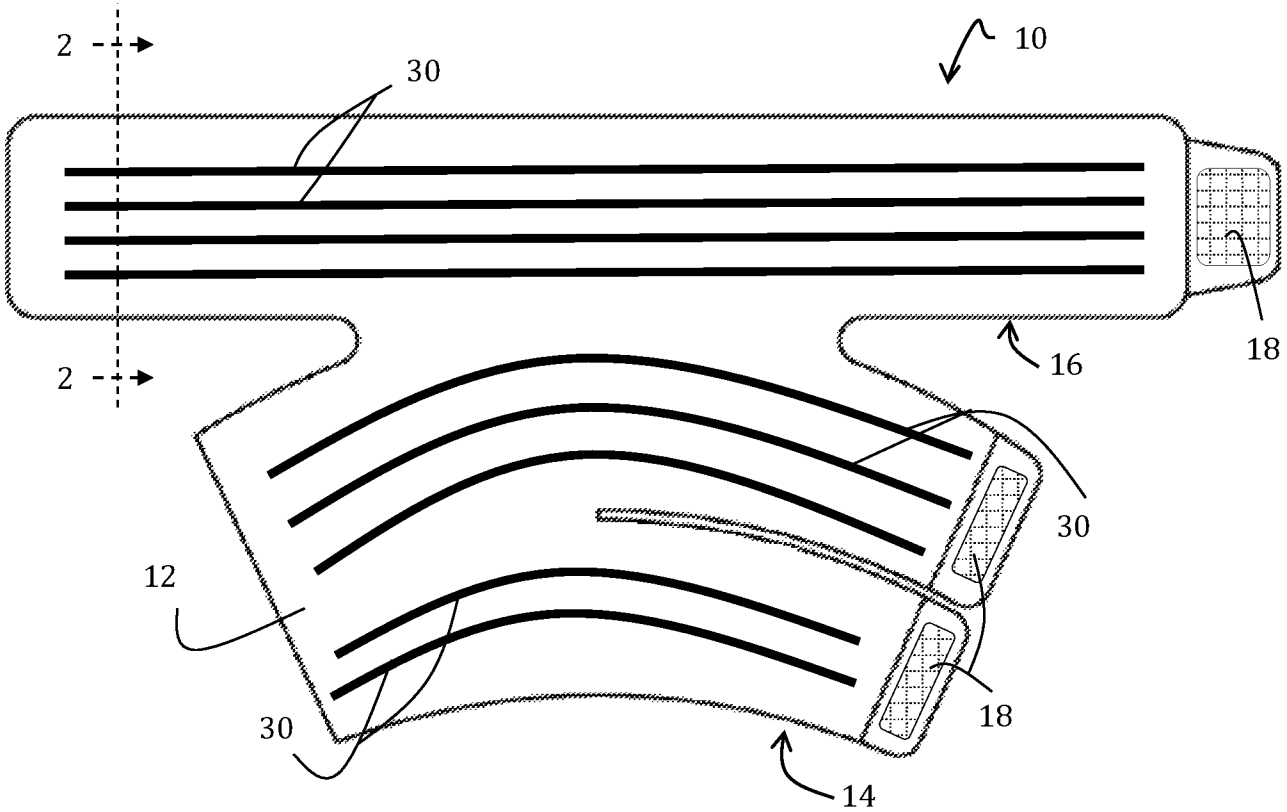
FIG. 1 is a top-down view of a compression wrap according to an embodiment of the present invention.

Referring now to the figures, and in particular to FIG. 1, a compression device 10 according to an embodiment of the present invention is shown. While the specific illustrative device 10 is configured to be wrapped around the calf, it would readily appreciated by those of ordinary skill in the art having the benefit of the disclosure herein that the compression device may suitably altered to accommodate other limbs or appendages of the patient, and according to a treatment requirement. Thus, the physical configuration of compression device 10 largely determines the limb or appendage to be treated. Moreover, size of the compression device 10 may be altered to account for differences in body sizes and proportions, for example, male versus female or adult versus child.

The compression device 10 includes a textile or fabric body 12 having a first, lower segment 14, for example, as configured to fit around the foot of the user, and a second, upper segment 16 configured to encircle the lower leg or calf. Yet, the skilled artisan could envision devices having only a single segment being suitable for wrapping about a calf, thigh, bicep, or forearm only. The body may alternatively be configured to fit at the knee or elbow of the user and having an opening therein to accommodate the knee or elbow joint.

Ends of each segment 14, 16 may include a fastener arrangement, such as the illustrated hook and loop (only loop portions 18 are shown) to permit adjustable fit around the user's foot and calf. Other means for adjustably fastening the body segments about the user's body are contemplated, such as an array of hooks, eyelets, zipper, VELCRO (Velcro, Industries, Curacao), or similar fastening devices.

The fabric body 12 is generally inelastic or only moderately "stretchable" so as to contact with the skin of the user. In that regard, materials comprising the fabric body are generally breathable materials configured to reduce perspiration or may be a generally impermeable material to enhance heating of the body part under compression treatment.

As shown in FIG. 2, the fabric body 12 is a layered structure, such layers including (proximally-to-distally from patient skin) a memory foam layer 20, voxelated liquid crystal elastomer layer (hereafter, "elastomer layer 22"), an activation element layer 24, and an outer product material 26.

The memory foam layer 20 may include a wicking compressible material, such as a soft compressible memory foam, that is adapted to lie against the patient's skin. According to some embodiments, the foam proximate the skin would be of a 5-9 PSI density Shore "0" Durometer rating of 20-28. This should be made of a memory foam material that will spring back to its original shape when pressure is removed.

The outer product material 26 of the device 10 may comprise a stretchable, breathable material fabrics, such as EMANA (Solvay S. A., Neder-Over-Hemmbeek, Brussels, Belgium) or LYCRA (Invista, Wichita, Kans.) or spandex.

The elastomer layer 22 may comprise a polymer 28 or other suitable inert material in which bands 30 of elastomer may be embedded, such elastomers described in U.S. application Ser. Nos. 15/135,087 and 15/135,108, filed on even date herewith, entitled VOXELATED LIQUID CRYSTAL ELASTOMERS and METHODS OF MAKING VOXELATED LIQUID CRYSTAL ELASTOMERS, by Timothy White et al., the details of which are incorporated herein by reference, each in its entirety. As described in greater detail in the co-pending application, the elastomer may be synthesized into the bands that extend across the fabric body 12 (FIG. 1) and configured so as to contract with applied stimulus. In that regard, the elastomer layer 22 is operably coupled to the activation element layer 24, which is configured to supply the stimulus by which the elastomers may contract. For example, the activation element layer 24 may be configured to supply heat or light as the stimulus.

Referring to FIGS. 1 and 2, the number and shape of bands 30 may vary and depends, for example, on the limb and/or appendage to be treated. As specifically illustrated, the lower segment 14 incorporates five bands 30 and is curved so as to more closely conform to a curved portion of the body, such as the calf. The upper segment 16 includes four bands 30 and is more linear such that it more closely conforms to a more cylindrical portion of the body, such as a portion of the leg above the ankle.

Elastomer comprising the bands 30, as is described in the co-pending application, may be configured to contract up to 50% of a relaxed length. Accordingly, when the activation element layer is activated, the elastomer will contract and if it is wrapped around an extremity, thereby applying compression. When the activation element layer 24 is inactivated, the elastomer would relax to the relaxed length.

The activation element layer 24, therefore, may comprise a unitary heating element, as is generally shown in FIG. 2. Heat may, therefore, be generated through a resistive heating mechanism. Resistance wire, such as nickel-chromium wire, may be utilized for heating to energize the elastomer. Another heat source, which may be utilized as an actuator, is a silicone rubber heater. Heater wires such as is found in an electric blanket may also be utilized as a method to actuate the liquid crystal elastomer. Alternatively, or additionally, the activation element layer 24 may comprise one or more light sources, such as light emitting diodes, to provide light activation is needed. This can be comprised of flexible strip led lighting or flexible led pads.

The heating or light elements may arranged into one or more zones, which would allow constriction control to only a certain portion or number of the bands 30 at a time. Further segmentation of the bands 30 combined with a plurality of zones may be suitably configured to provide control to yield constriction in a messaging manner, if desired. Alternatively, all bands 30, zones, or both may constricted at once to apply compression in a bandage configuration to maintain constant pressure to a wound. Such zoned activation may be beneficial in custom fitting the compression device to the patient's particular anatomy. Alternatively, or additionally, the zoned activation may be beneficial is providing a compression massage, which encourages blood flow to the extremity.

According to another embodiment of the present invention, the bands 30 may be constructed from electro active polymers to form liquid crystal elastomers. As such, electrical energy may be the stimulus to which the bands 30 respond by outputting mechanical work, without the need of a secondary energy source (from heat or light, for example). A net effect would be that the bands 30 may generate large strains at comparatively low electric fields. Bands 30 according to this embodiment would become part of an electrical circuitry (described below) device 10 and would shrink or compress when electric potential is applied.

Figure 3:
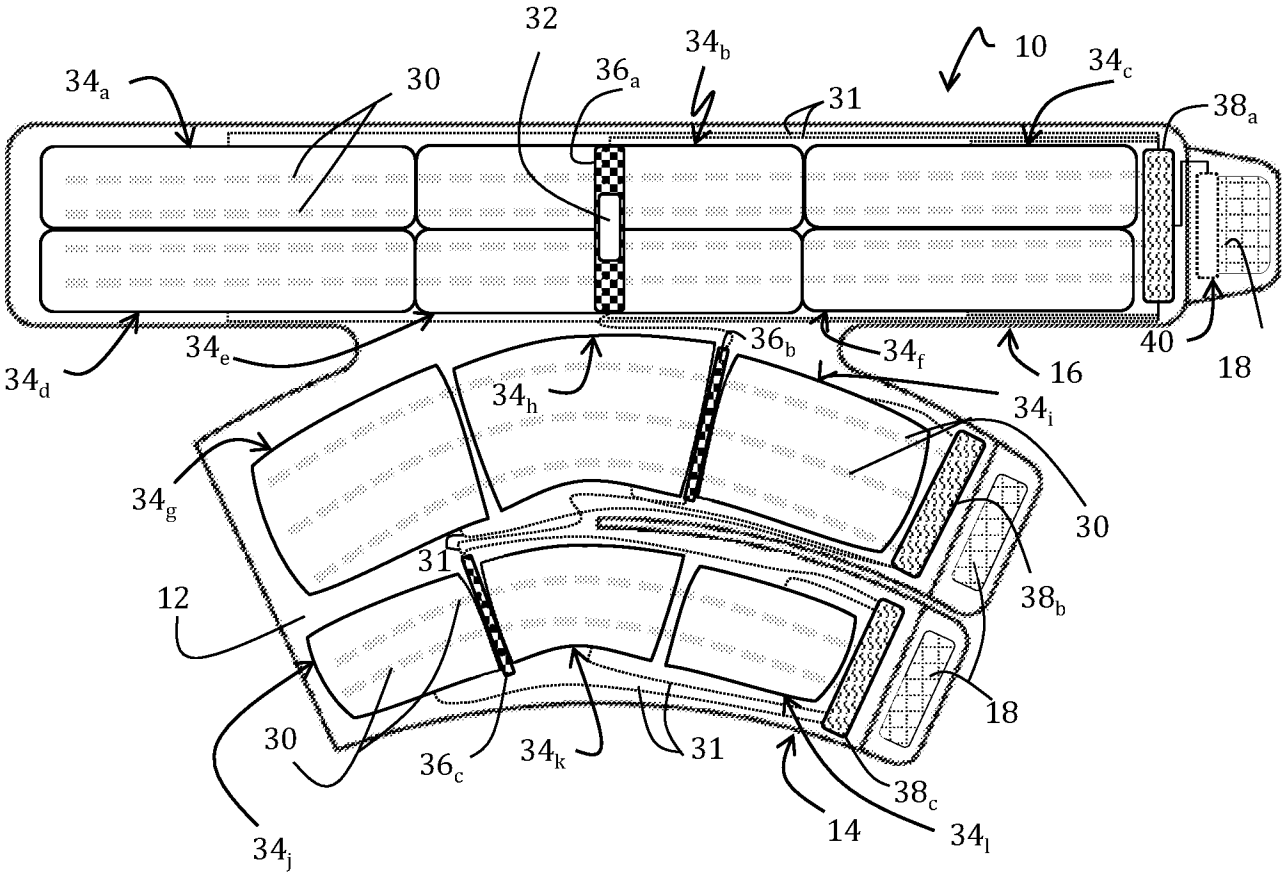
FIG. 3 is a top-down view of a compression wrap according to another embodiment of the present invention.

Referring now to FIG. 3, and so as to effectuate the controlled constriction of the bands 30 (shown here in phantom), the activation element layer 24 (FIG. 2) may be operably coupled to an onboard microprocessor 32. As specifically illustrated, the element layer 24 (FIG. 2) is configured into a plurality of zones 34*a*, 34*b*, 34*c*, 34*d*, 34*e*, 34*f*, 34*g*, 34*h*, 34*i*, 34*j*, 34*k* with each zone 34*a*, 34*b*, 34*c*, 34*d*, 34*e*, 34*f*, 34*g*, 34*h*, 34*i*, 34*j*, 34*k* being coupled to the microprocessor 32, at least one circuit board 36*a*, 36*b*, 36*c*, and at least one anode 38*a*, 38*b*, 38*c* for purposes of electrical grounding. Additionally, the microprocessor 32 may be operably coupled to a power supply 40, which is schematically shown here in phantom.

In that regard, wires 31 (all wires being labeled the same) associated with each zone 34*a*, 34*b*, 34*c*, 34*d*, 34*e*, 34*f*, 34*g*, 34*h*, 34*i*, 34*j*, 34*k* may be electrically coupled to a respective channel, which may further be electrically coupled to the respective circuit boards 36*a*, 36*b*, 36*c*. If necessary, a flexible multi-conductor cable may connect the circuit boards 36*a*, 36*b*, 36*c* so that the circuit boards 36*a*, 36*b*, 36*c* do not interfere with an ability of the compression device 10 to be wrapped snugly about the user's limb.

The circuit boards 36*a*, 36*b*, 36*c* may be configured to control the sequence and magnitude of constriction applied to the current applied to the bands 30 via respective channels. As shown in FIG. 4, distribution circuit boards 36*a*, 36*b*, 36*c* may include switches 33, 35, surface mount resistors 37*a*, 37*b*, 37*c*, 37*d*, 37*e*, 37*f*, 37*g*, and 39*a*, 39*b*, 39*c*, 39*d*, 39*e*, 39*f*, 39*g*, electrically connected to the wires associated with each channel 41*a*, 41*b*, 41*c*, 41*d*, 41*e*, 41*f*, 41*g* (FIG. 5).

The microprocessor 32, while not specifically illustrated in FIG. 4, may be hard-wired to the circuit board 36*a*, 36*b*, 36*c* according to some embodiments of the present invention. In still other embodiments of the present invention, the microprocessor 32 is not wired so as to be replaceable to customize pre-programming. For example, according to one particular embodiment, various microprocessors 32 may be preprogrammed with varying compression sequence, which may be specific or customized for particular users, particular medical need, particular compression device 10, or particular functionality. In that way, the microprocessor 32 and programming may be selected by the user or physical therapist as desired.

Figure 5:
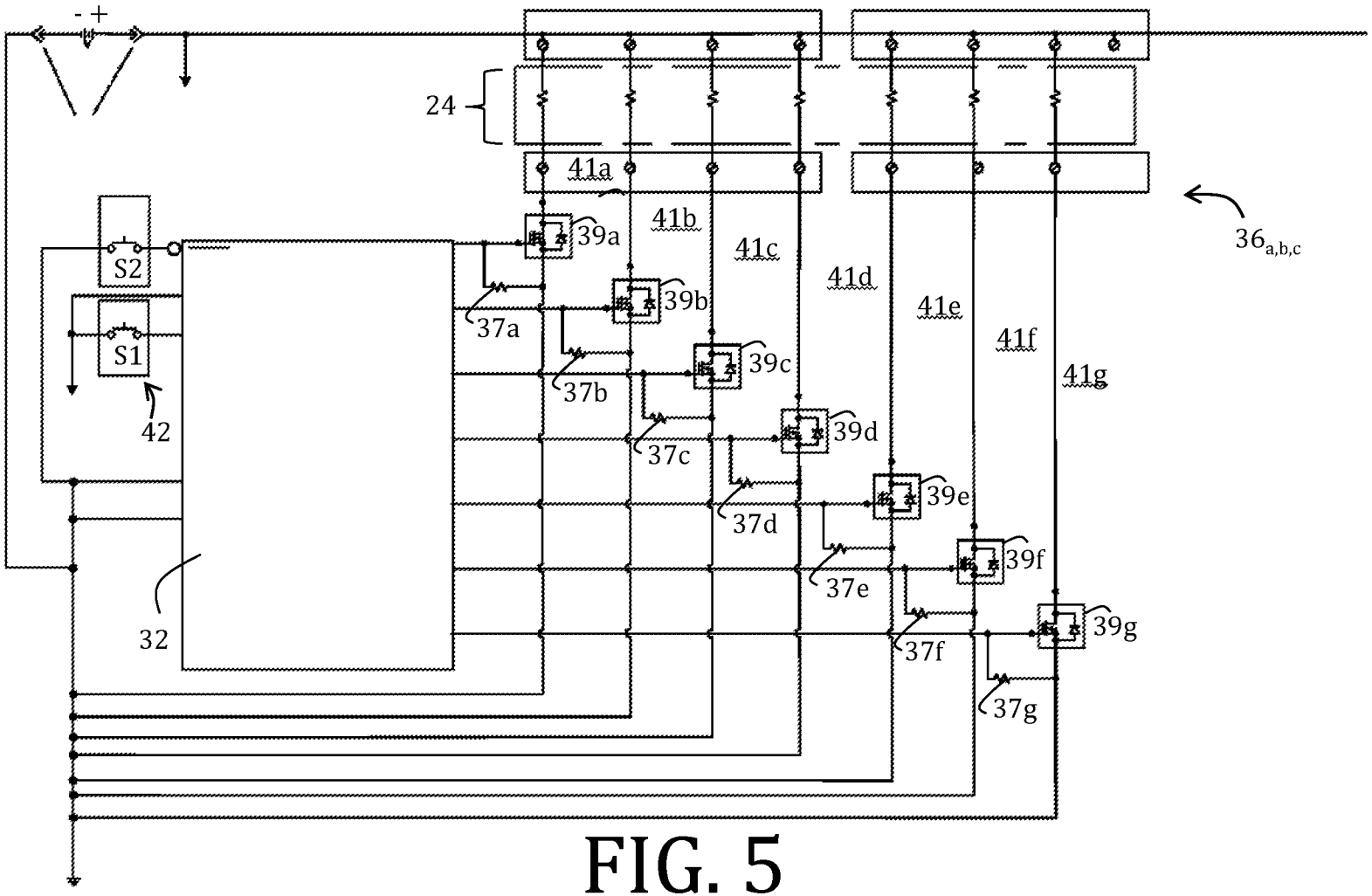
FIG. 5 is a schematic illustration of an exemplary microprocessor suitable for use with embodiments of the present invention.

Additional details of the circuit boards 36*a*, 36*b*, 36*c* and the microprocessor 32 are shown in the circuit diagram of FIG. 5. The microprocessor 32 may, for example, be a Parallax micro-controller Part No. BS2-IC (Parallax, Inc., Rocklin, Calif.). Such commercially-available microprocessor 32 includes a switch array 42, which includes a mode switch (labeled as "S1") and a reset switch (labeled as "S2"). The switches S1, S2 are accessible by the user to operate the compression device 10 (FIG. 1). Alternatively, the switches S1, S2 may be integrated into a remote communication module capable of wireless communication from outside the compression device 10 (FIG. 1). The circuit board 36*a*, 36*b*, 36*c* may thus incorporate a transmitter/receiver component coupled to the switches S1, S2, such as an RF, Bluetooth, Wi-Fi, or Spec 802.11g devices. The compression device 10

(FIG. 1) may be equipped with a USB type connection (not shown) for charging the power supply and for data download or upload.

The microprocessor 32 may include a memory for storing actuation data, and may further integrate with sensors on the circuit boards 36*a*, 36*b*, 36*c* that may sense and "report" pressure and temperature, for instance. In one aspect, the microprocessor 32 is thus configured to communicate with a handheld device, such as an iPad, iPod, smart phone, or with another computing device equipped with wireless transmission/receiving capabilities, such as a computer 70, which is generally and schematically illustrated in FIG. 6. The remote device may then serve to receive and record actuation data, and may act as a master controller for the micro-controller, whether to activate either of the two switches, or in a more advanced configuration to remotely configure or program the micro-controller.

Referring again to FIG. 3, the power supply 40 may be operably coupled to the circuit boards 36*a*, 36*b*, 36*c* and grounded to the negative anodes 38*a*, 38*b*, 38*c*. In one embodiment, the power supply may be a 7.5 volt, 40 AH lithium cell array contained with a designated pouch within the fabric body 12 for storage. Such pouch may be configured to insulate the user from any heat build-up that might occur when the battery is powering the compression device 10. The power supply 40 may be a rechargeable battery that can be recharged through the remote link to the microprocessor 32 described above.

The microprocessor 32 may implement software for controlling the sequence and pattern of compression that will be followed through a treatment process. According to one embodiment, the microprocessor 32 may be activated and controlled by a remote device, as described above. Additionally, the microprocessor 32 may have basic user controls embedded within the fabric body 12, such as a control panel affixed to the outside of one of the fabric segments.

Figure 6:
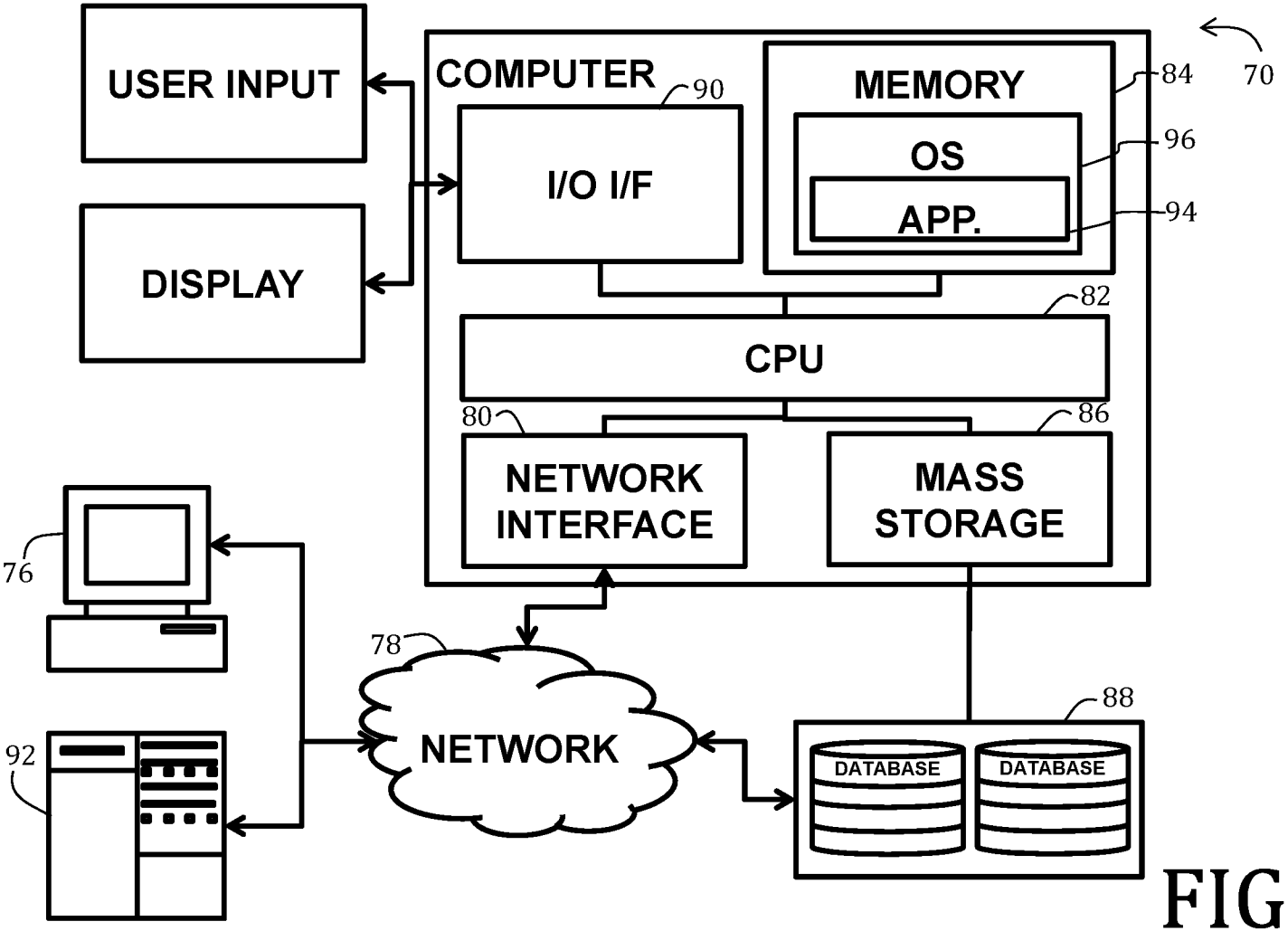
FIG. 6 is a schematic illustration of a computer suitable for use with embodiments of the present invention.
Figure 8:
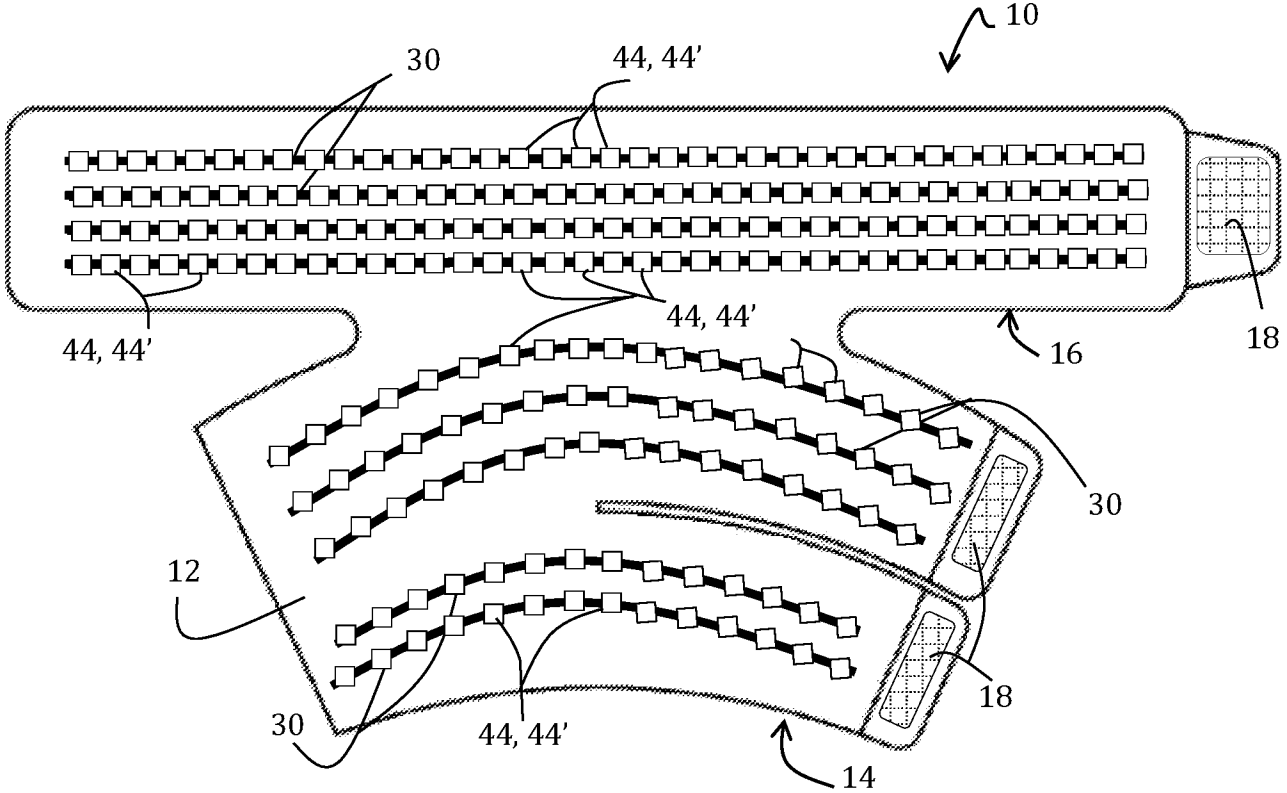
FIG. 8 is a top-down view of a compression wrap according to yet another embodiment of the present invention.

With reference now to FIG. 6, a computer 70 suitable for use with the present invention is shown and may be considered to represent any type of computer, computer system, computing system, server, disk array, or programmable device such as multi-user computers, single-user computers, handheld devices, networked devices, or embedded devices, etc. The computer 70 may be implemented with one or more networked computers 76 using one or more networks 78, e.g., in a cluster or other distributed computing system through a network interface 80 (illustrated as "NETWORK I/F"). The computer 70 will be referred to as "computer" for brevity's sake, although it should be appreciated that the term "computing system" may also include other suitable programmable electronic devices consistent with embodiments of the invention.

The computer 70 typically includes at least one central processing unit 82 (illustrated as "CPU") coupled to a memory 84 along with several different types of peripheral devices, e.g., a mass storage device 86 with one or more databases 88, an input/output interface 90 (illustrated as "I/O I/F"), and the Network I/F 80. The memory 84 may include dynamic random access memory ("DRAM"), static random access memory ("SRAM"), non-volatile random access memory ("NVRAM"), persistent memory, flash memory, at least one hard disk drive, and/or another digital storage medium. The mass storage device 86 is typically at least one hard disk drive and may be located externally to the computer 70, such as in a separate enclosure or in one or more networked computers 76, one or more networked storage devices (including, for example, a tape or optical drive), and/or one or more other networked devices 92 (including, for example, a server).

The CPU 82 may be, in various embodiments, a single-thread, multi-threaded, multi-core, and/or multi-element processing unit (not shown) as is well known in the art. In alternative embodiments, the computer 70 may include a plurality of processing units that may include single-thread processing units, multi-threaded processing units, multi-core processing units, multi-element processing units, and/or combinations thereof as is well known in the art. Similarly, the memory 84 may include one or more levels of data, instruction, and/or combination caches, with caches serving the individual processing unit or multiple processing units (not shown) as is well known in the art.

The memory 84 of the computer 70 may include one or more applications 94 (illustrated as "APP."), or other software program, which are configured to execute in combination with the Operating System 96 (illustrated as "OS") and automatically perform tasks necessary for operating the transducers and/or reconstructing the images with or without accessing further information or data from the database(s) 88 of the mass storage device 86.

Those skilled in the art will recognize that the environment illustrated in FIG. 4 is not intended to limit the present invention. Indeed, those skilled in the art will recognize that other alternative hardware and/or software environments may be used without departing from the scope of the invention.

Referring now to FIGS. 1, and 7A-8, the compression device 10, according to some embodiments of the present invention, may further incorporate a plurality of pads 44, 44' (alternate embodiments illustrated, respectively) configured to apply additional, localized pressure. Each pad 44, 44' includes an inner portion 46, 46' and an outer portion 48, 48'. According to some embodiments of the present invention, the inner portion 46, 46' may be formed of a material to provide a hard generally non-compressible surface, such as a nylon having a durometer value of about 110. The outer portion 48, 48' may be formed of a wicking, compressible material, such as a soft compressible memory foam that is configured to be positioned against the skin of the user. Accordingly, the inner portion 46, 46' may be fastened or otherwise affixed to the fabric body 12 in a suitable manner, such as by use of an adhesive.

As specifically illustrated in FIG. 7B, the inner portion 46' of each pad 44' may include one or more, and preferably two, bores 50. Each bore 50 is configured to receive or otherwise provide coupling to a band 30, as described herein, and as specifically illustrated in FIG. 8.

While not specifically illustrated herein, an additional layer of material may line exposed surfaces of the inner portion 46, 46' of the pads 44, 44', which contacts the extremity surface. For instance, the fabric body 12 may be provided with a soft, breathable sheet of material that is affixed to the fabric body 12 to cover the pads 44, 44'. The additional sheet may be removable fastened, such as by hook and loop fasteners at its ends.

As explained in more detail herein, pressure may be sequentially applied to certain groups of pads 44, 44' when wrapped around the extremity to apply alternating pressure to specific locations of the patient's or athlete's extremity, such as the ankle and lower calf in the illustrated embodiment. According to certain compression protocols, an applied compression force may be as high as 10 psi; although, compression force in most applications is only about 5 psi. Thus, the pads 44, 44' may be configured to uniformly transmit this range of pressures. In some embodiments, dimensions of each pad 44, 44' is in the form of a 1 cm×1 cm rectangle. The pads 44, 44' may be arranged in rows, for example, separated by a distance ranging from 0.25 cm to about 0.75 cm. Some embodiments may include a separation distance of about 4 cm in order to provide an optimum pressure profile to the patient/athlete's limb.

The manner in which pressure is applied to the user's body depends upon the number and arrangement of the bands 30, the pads 44, 44', and the channels. For example, with reference to FIG. 8, when the pads 44, 44' are arranged as shown, the bands 30 and thus the pads 44, 44' may be actuated in a sequential manner, for example, from a medial portion of the compression device 10 to a distal portion of the compression device 10. Successive rows of bands 30 and pads 44, 44' may be gradually deactivated, or expanded, and gradually activated, or contracted. Different activation patterns can be pre-programmed into the micro-controller or administered by the remote device as described above. When a channel is activated, the microprocessor 32 directs current to the specific channel which causes the activation element layer 24, thereby causing the bands 30 to contract or shrink and reducing the effective diameter of the bands 30 when wrapped around a limb. This reduction in diameter translates to an application of points of pressure by way of the pads 44, 44'. When the current is removed or changed, the bands 30 relax and thereby remove pressure from the associated compressible pads 44, 44'.

Figure 9:
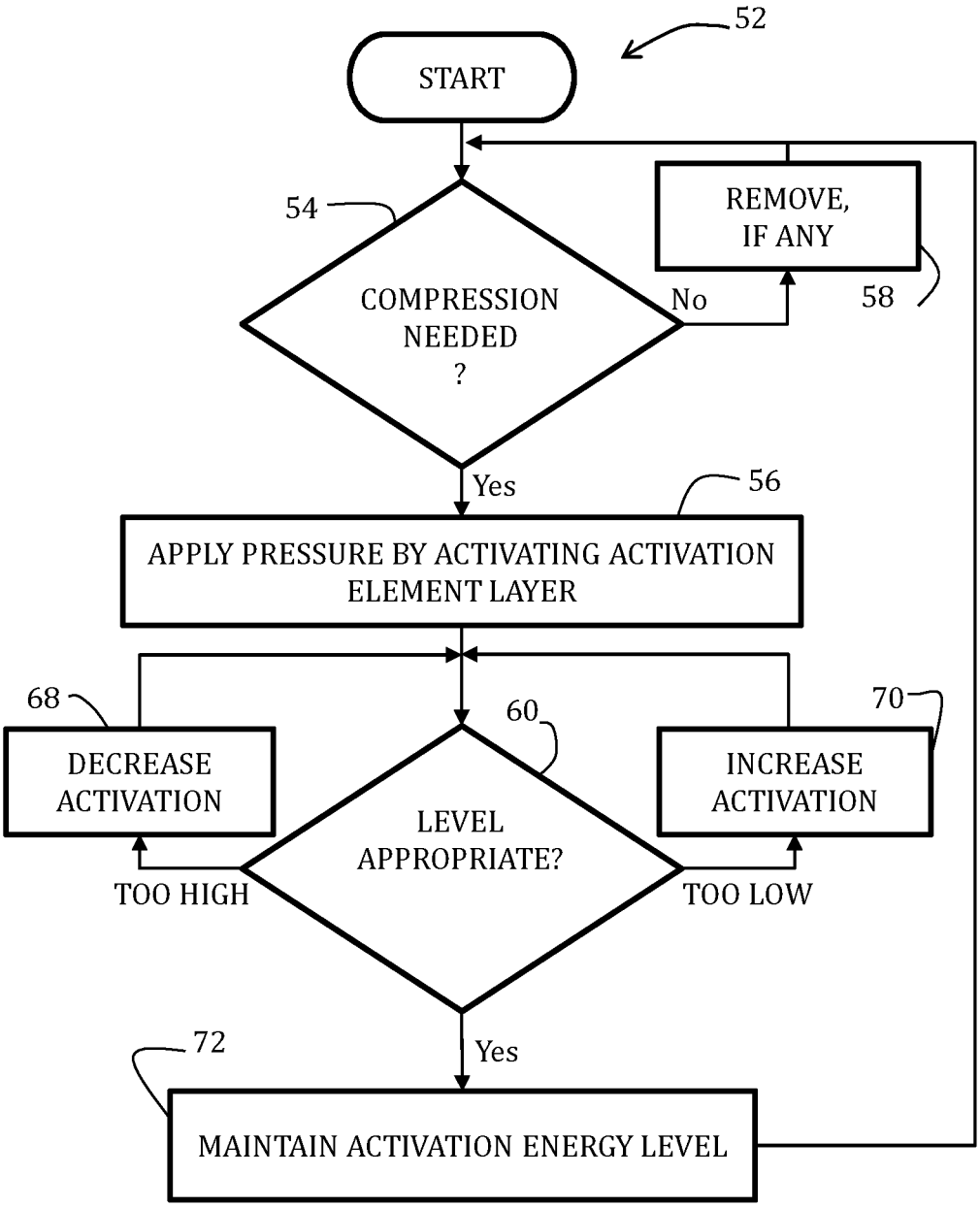
FIG. 9 is a flowchart illustrating a method of using a compression wrap according to an embodiment of the present invention.
Figure 10:
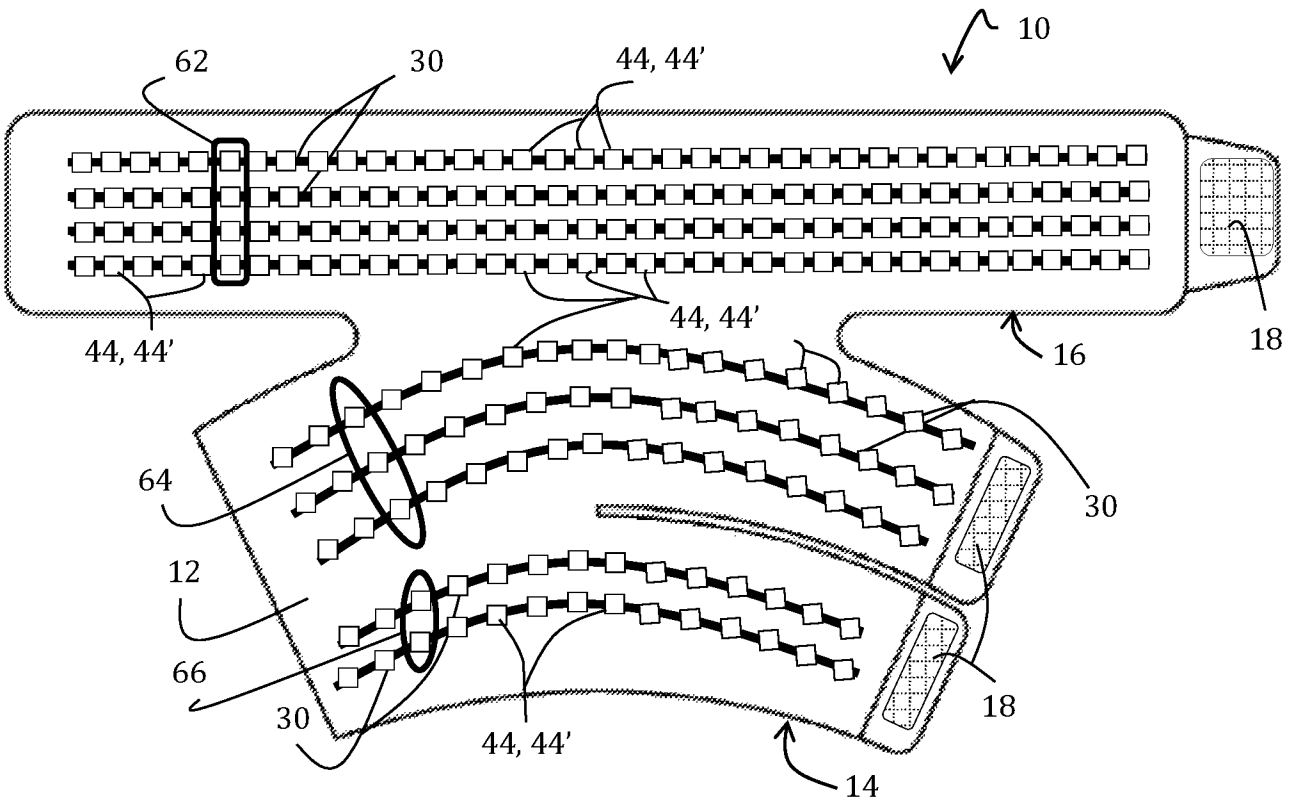
FIG. 10 is a top-down view of a compression wrap according to yet another embodiment of the present invention and incorporating air bladders according to the method of FIG. 9.

With reference now to FIGS. 9 and 10, a method 52 of using device 10 (as illustrated in FIG. 10) is described with greater detail. At start, the need for compression is determined (Block 54). If compression is needed or desired ("Yes" branch of decision block 54), then the computer and microprocessor 32 (FIG. 3) may be actuated such that the activation element layer 24 (FIG. 2) is activated, causing the bands 30 to compress and apply pressure to the body part (Block 56). If no pressure is needed ("No" branch of decision block 54), then, if any pressure is present, is removed (Block 58) and the method continues.

The computer, microprocessor 32 (FIG. 3), and other hardware may be programmed in such a way as to set forth a feedback mechanism for the device 10. In that regard, and continuing with FIGS. 9 and 10, the appropriateness of the pressure level applied to the body may be determined (Block 60). Determining the pressure level, according to some embodiments of the present invention, may include air bladders 62, 64, 66 (three are shown) associated with columns of pads 44, 44' of the device 10. The air bladders 62, 64, 66 will be compressed by the bands 30 and may be interfaced to small pressure sensors (not shown) that provide feedback signals to the microprocessor 32 (FIG. 3). The spacing of these pressure sensors may be such that it will provide the microprocessor 32 (FIG. 3) an overall average pressure perceived the wearer of the device 10. From the compression pressure force feedback signal, the microprocessor 32 (FIG. 3) may regulate the amount of activation energy (for example, the heat or light) applied to the activation element layer 24 (FIG. 2), which is related to compression of the bands 30. For instance, if the pressure applied is too high ("Too high" branch of decision block 60), then the amount of heat or light (or other appropriate stimulus) applied may be decreased (Block 68), resulting in decreased pressure applied. If the pressure applied is too high, ("Too low" branch of decision block 60), then the amount of heat or light (or other appropriate stimulus) applied may be increased (Block 70), resulting in increased pressure applied. If the pressure is appropriate, then the activation energy level may be maintained (Block 72) and the process continues.

While not specifically illustrated herein, and in accordance with other embodiments of the present invention, the fabric body may be provided with pockets or sleeves to receive and retain the compressible pads. It is further contemplated that each row of compressible pads is replaced by a single elongated compressible cushion element with the bores passing therethrough to receive the corresponding bands. It is further contemplated that the fabric body may be configured so that the compressible pads or elongated cushion elements are sewn into the fabric body.

In an alternative embodiment, multiple pads positioned in two or more adjacent rows may be replaced with an elongated compressive pad that extends along each side of the fabric body. The bands may then be embedded with the elongated pad in the manner described above, and each row of elongated compressive pads may be actuated in the same manner as the plurality of smaller pads described above.

According to some embodiments of the present invention, additional tensioning elements may be incorporated with or without the pads described above. Such tensioning elements may comprise a wire of a "shape memory" material or alloy that shrinks when a current is applied to the wire, and that returns to its original "memory" configuration when the current is removed or changed. The compression integument includes a "memory" wire array that spans the width and length of each segment of the fabric body, and that extends through the bores in each compression pad. In certain embodiments, the memory wire can include wires formed of Nitinol or Dynalloy having a diameter of 0.008 in. In one specific embodiment, the memory wires are configured so that a current of 0.660 amp passing through each wires causes it to shrink sufficiently to exert a force of about 1.26 lbf to 4 lbf.

In an alternative embodiment, a compression device have elements as described herein, may be formed into a shape of an interior sock or an exterior sock. The interior sock incorporates compression pads that encircle the limb and which may be an elongated cushion, as described above, or may be similar to pads. The pads may be thermally conductive to convey heat generated by the memory wires to the user's skin. Alternatively, the pads may be thermally insulating to minimize the transmission of heat to the user. The outer sock is integrated over the inner sock and includes the memory wires, each aligned with a corresponding pad. The electronics, including the power supply and micro-controller, may be incorporated into a ring at the top of the sock-shaped integument.

The advantage to the warfighter is that this could be utilized for the soldier that must spend hours hiking or on his feet in the form of quicker recovery from strenuous activity. For the medical marketplace, this device could be utilized for bedridden patients starting recovery or beginning therapy, while allowing mobility and removing the need for inflation pumps that current technology requires.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A method of using a compression device having a compressible body configured to encircle a limb of a user and comprising an elastomer layer, an activation element layer, the elastomer layer comprising a plurality of voxelated liquid crystal elastomers configured to contract in response to a stimulus thereby tensioning the compressible body about the limb of the user, and the activation element layer configured to supply the stimulus, the method comprising:

encircling the limb of a user with the compression device;

activating the activation element layer at a first level to supply the stimulus and contracting the elastomer layer;

determining an applied pressure level; and in response to the determination, adjusting the activation of the activation element layer to a second level if the determined applied pressure level is above a threshold or adjusting the activation of the activation element layer to a third level if the determined applied pressure level is below a threshold, wherein the second level is less than the third level.

2. The method of claim 1, wherein the compression device further comprises:

a compressible pad coupled to a surface of the compressible body, the compressible pad having an inner portion configured to couple the compressible pad to the compressible body and an outer portion configured to be placed proximate to the limb of the user.

3. The method of claim 2, wherein the compression device further comprises:

a plurality of air bladders, each air bladder of the plurality associated with at least one compressible pad; and a pressure sensor associated with each air bladder of the plurality, the pressure sensor configured to measure the applied pressure level between the respective one of the plurality of air bladders and the user.

4. A compression device for applying controllable compression to a limb of a user, the compression device comprising:

a compressible body configured to encircle the limb of the user and comprising an elastomer layer comprising a plurality of bands comprising electro active polymers configured to contract in response to a stimulus, such contraction configured to tension the compressible body about the limb of the user; and an energy supply configured to supply an electrical stimulus to actuate at least a portion of the elastomer layer, wherein the elastomer layer includes a plurality of voxelated liquid crystal elastomers configured to contract in response to the electrical stimulus.

5. The compression device of claim 4, further comprising:

a fastener configured to releasably secure the compressible body about the limb of the user.

6. The compression device of claim 4, wherein the compressible body further comprises:

a first segment configured to encircle a first portion of the limb of the user; and a second segment configured to encircle a second portion of the limb of the user.

7. The compression device of claim 6, wherein the first and second portions of the limb of the user are separated by a joint.

8. The compression device of claim 6, further comprising:

a circuit board within each of the first and second segments, each circuit board being operably coupled to the energy supply and configured to control the actuation of the bands of the plurality within the respective one of the first and second segments.

9. The compression device of claim 8, further comprising:

a distribution board within each of the first and second segments; and a ground plane within each of the first and second segments.

10. The compression device of claim 4, wherein the compressible body further comprises:

a compressible pad coupled to a surface of the compressible body, the compressible pad having an inner portion configured to couple the compressible pad to the compressible body and an outer portion configured to be placed proximate to the limb of the user.

11. The compression device of claim 10, wherein the compressible pad is operably coupled to the elastomer layer.

12. The compression device of claim 10, wherein the compressible pad includes an elongated cushion.

13. The compression device of claim 10, wherein the compressible pad further comprises:

a rigid portion configured to resist pressure applied to the compressible pad.

14. The compression device of claim 13, wherein the rigid portion of the compressible pad further comprises:

a bore configured to receive at least a portion of the elastomer layer such that contraction of the elastomer layer causes the compressible pad to be pressed against the limb of the user.

15. The compression device of claim 4, further comprising:

a microprocessor based actuator configured for remote communication with a device external to the user.

16. The compression device of claim 15, wherein the external device is a handheld device capable of wireless communication with the microprocessor based actuator.

17. The compression device of claim 15, further comprising:

a microprocessor for the actuator programmed to execute a compression protocol stored in a memory of the microprocessor.

18. The compression device of claim 17, wherein the compression protocol is configured to sequentially actuate a first portion of the elastomer layer and a second portion of the elastomer layer.

* * * * *